US007325522B2

(12) United States Patent
Schmidt

(10) Patent No.: US 7,325,522 B2
(45) Date of Patent: Feb. 5, 2008

(54) VALVE DRIVE FOR A CAM-OPERATED VALVE

(75) Inventor: Volker Schmidt, Burgbernheim (DE)

(73) Assignee: Schaeffler KG, Herzogenaurach (DE)

( * ) Notice: Subject to any disclaimer, the term of this patent is extended or adjusted under 35 U.S.C. 154(b) by 164 days.

(21) Appl. No.: 11/242,535

(22) Filed: Oct. 3, 2005

(65) Prior Publication Data

US 2006/0070593 A1 Apr. 6, 2006

(30) Foreign Application Priority Data

Oct. 2, 2004 (DE) ..... 10 2004 048 071

(51) Int. Cl.
*F01L 1/02* (2006.01)

(52) U.S. Cl. ..... 123/90.27; 123/90.16; 123/90.48

(58) Field of Classification Search ..... 123/90.27, 123/90.16, 90.12, 90.48, 90.15
See application file for complete search history.

(56) References Cited

FOREIGN PATENT DOCUMENTS

| | | |
|---|---|---|
| DE | 38 55 394 | 5/1989 |
| DE | 42 02 506 | 8/1992 |
| DE | 43 05 068 | 9/1994 |
| DE | 42 35 620 | 4/1999 |
| DE | 101 63 824 | 7/2003 |
| DE | 10 2004 054 366 | 6/2005 |
| GB | 2 066 403 | 7/1981 |

*Primary Examiner*—Zelalem Eshete
(74) *Attorney, Agent, or Firm*—Volpe and Koenig, PC

(57) ABSTRACT

A valve drive (1) for a cam-operated valve (2) of an internal combustion engine is provided, in which a closing force is applied to the valve (2) against the opening direction of the valve (2) by a valve spring (3). The valve drive includes a hydraulic force application device (4), with which a force can be applied directly or indirectly against the direction of the closing force onto the valve (2), and includes a piston (5) that is moveable in a displacement direction (R) relative to a cylinder (6) of the force application device (4) by the introduction of hydraulic fluid into the pressure chamber (7) formed between the piston (5) and the cylinder (6). The piston (5) can move relative to the cylinder (6) from a first end position (A) into a second end position (B). In order to achieve improved damping of the piston in the region of the end positions, a braking or damping system (8, 9) is provided with which the movement of the piston (5) can be braked relative to the cylinder (6) when a predetermined relative position between the piston (5) and cylinder (6) is reached and until one of the end positions (A, B) is reached.

15 Claims, 6 Drawing Sheets

VALVE DRIVE FOR A CAM-OPERATED VALVE

BACKGROUND

The invention relates to a valve drive for a cam-operated valve of an internal combustion engine, in which a closing force is applied to the valve against the opening direction of the valve by a valve spring, with a hydraulic force application device, with which a force can be applied directly or indirectly onto the valve against the direction of the closing force, in that a piston of the force application device is moved relative to a cylinder of the force application device by introducing hydraulic fluid into the pressure chamber formed by the piston and the cylinder in a displacement direction, wherein the piston can be moved relative to the cylinder from a first end position to a second end position.

Valve drives of this type are known in the state of the art, for example, from DE 101 56 309 A1 and from U.S. Pat. No. 4,796,573. They are used to generate additional valve lifting in addition to the opening lift of the valve that is dependent on the shape of the cam of a camshaft. For this purpose, a force application device is pressurized with hydraulic fluid in such a way that the valve lifting is, to a large extent, variable.

In DE 102 42 866 A1, which also belongs to this class, such a variable valve drive is provided, such that the valve lifting caused by the cams of the camshaft can be minimized by a control valve by shutting off hydraulic fluid from the control chamber of the force application device, whereby the control chamber can be connected to hydraulic fluid at high pressure.

The valve timing device known from EP 0 196 441 B1 has a valve piston, which has a stepped section in the form of an annular radial shoulder on one end. Through a special configuration of the valve piston, during the shut-off process, thus when compressed fluid from the working chamber of the force application device is shut off and therefore when the valve piston returns, an annular gap in a stepped and continuously tapering configuration is produced, whereby a pressure can be established, which generates end position damping of the valve piston.

Although an essentially variable influence on the valve lifting is already possible with the known valve drives, wherein damping of the movement of the force application device can also be realized in the end position, the known systems have a few disadvantages.

The targeted path-controlled braking of the piston of the force application device is not possible relative to the cylinder for a few solutions. Instead, as, for example, in U.S. Pat. No. 4,796,573, pressurization with hydraulic fluid is necessary for braking the piston, wherein the dynamics of the braking process are produced from the hydraulic behavior of the hydraulic elements used there.

Furthermore, in some of the known solutions, there is a relatively slow acceleration of the piston from the damping end position, which is disadvantageous.

The stepped pistons also known for targeted braking of the piston cause considerable production problems from time to time or have a complicated overall structure for the force application device as a result, which makes the systems costly.

If maximum stroke limiting through hydraulic shutoff is used, such force application devices have the disadvantage that the shutoff is burdened with losses, whereby the efficiency of the device is decreased.

SUMMARY

Therefore, the present invention is based on the object of improving a valve drive of the type named above, so that the listed disadvantages are prevented. Therefore, the force application device distinguishes itself in that it or its components can be produced easily in large batches economically. Furthermore, the device should enable fast acceleration of the piston of the force application device from the end position, whereby the dynamic response of the system should be high. Furthermore, in terms of an optional hydraulic lash adjustment function, there should be freedom from feedback, i.e., the end position damping or braking should have no effect thereon.

This object is met according to the invention in that the movement of the piston relative to the cylinder can be braked when a predetermined relative position is reached between the piston and cylinder and until one of the end positions is reached.

Then, when a defined relative displacement of the piston of the force application device to the cylinder of the device is reached, the braking or damping process is triggered, wherein it requires no startup or shutoff from the outside.

A preferred configuration of the invention provides that the braking is provided by a braking piston, which is supported so that it can move relative to the piston of the force application device in the displacement direction and can move relative to the cylinder in the displacement direction, wherein an oil chamber is formed between the piston and the braking piston, which is sealed from the pressure chamber formed between the piston and the cylinder, and wherein there are closing means, which open a fluid opening after exceeding a predetermined displacement of the braking piston relative to the cylinder and close this opening again after falling below this displacement, whereby a fluid connection between the pressure chamber formed between the piston and cylinder and the oil chamber can be created or blocked.

This end position damping or braking is used preferably for each end position of the force application device, in which it is not pressurized with hydraulic fluid.

For this solution, it has proven especially advantageous that the braking piston is supported in a preferably cylindrical recess in the piston. Between the pressure chamber formed between the piston and cylinder and the oil chamber formed between the piston and braking piston, there can be an aperture, which permits an overflow of hydraulic fluid between the oil chamber and pressure chamber, especially an outflow of fluid possibly only in the direction from the oil chamber to the pressure chamber. Here, the aperture can have a constant aperture cross section or else also a varying aperture cross section over the displacement path between the piston and braking piston.

An especially precise triggering of the damping or braking process of the piston relative to the cylinder is enabled, if, according to the refinement, the closing element is formed by a pin, which is connected rigidly to the cylinder and which interacts with the fluid opening in the braking piston. The piston, braking piston, and pin can be arranged concentric to a longitudinal axis of the force application device. Furthermore, preferably a spring element is arranged between the piston and braking piston, which presses the braking piston away from the piston. Finally, limiting means, which limit the displacement of the braking piston relative to the piston, have proven advantageous.

An alternative possibility for reducing the invention to practice is provided in that the braking of the movement of the piston is provided by a damping plate arranged on the piston, which can move into a damping chamber formed in the cylinder in one of the end positions for the movement of the piston relative to the cylinder.

The damping chamber can be in fluid connection with the pressure chamber formed between the piston and cylinder or can be a component of this pressure chamber.

For influencing the braking characteristics, the damping chamber can have a radially outer, conical side wall. The damping plate can be pressed against an axial stop on the piston by a spring element. It is especially preferred if, in the position contacting the axial stop, the damping plate opens an overflow channel between the pressure chamber formed between the piston and cylinder and the damping chamber, wherein the damping plate closes the overflow channel in the state pressed away from the axial stop.

The force application device is preferably arranged between a cam and the valve; in a preferred configuration, the force application device is part of a valve rocker lever support part for supporting a valve rocker, especially a cam operated finger lever, operating the valve.

With the proposed configuration of a valve drive, a force application device that can be produced easily in terms of manufacturing can be created, which can be realized cost-effectively in series production.

The force application device enables a precisely controlled damping or braking of the piston relative to the cylinder when a defined relative position of the two components to each other is reached. This also provides maximum lift limiting for the piston movement.

Furthermore, the force application device is distinguished by fast acceleration of the piston from the damping end positions. If the system is combined with hydraulic lash adjustment, the force application device has no effects on the compensation.

BRIEF DESCRIPTION OF THE DRAWINGS

In the drawings, exemplary embodiments of the invention are shown. They show.

DETAILED DESCRIPTION OF THE PREFERRED EMBODIMENTS

Figure 1:
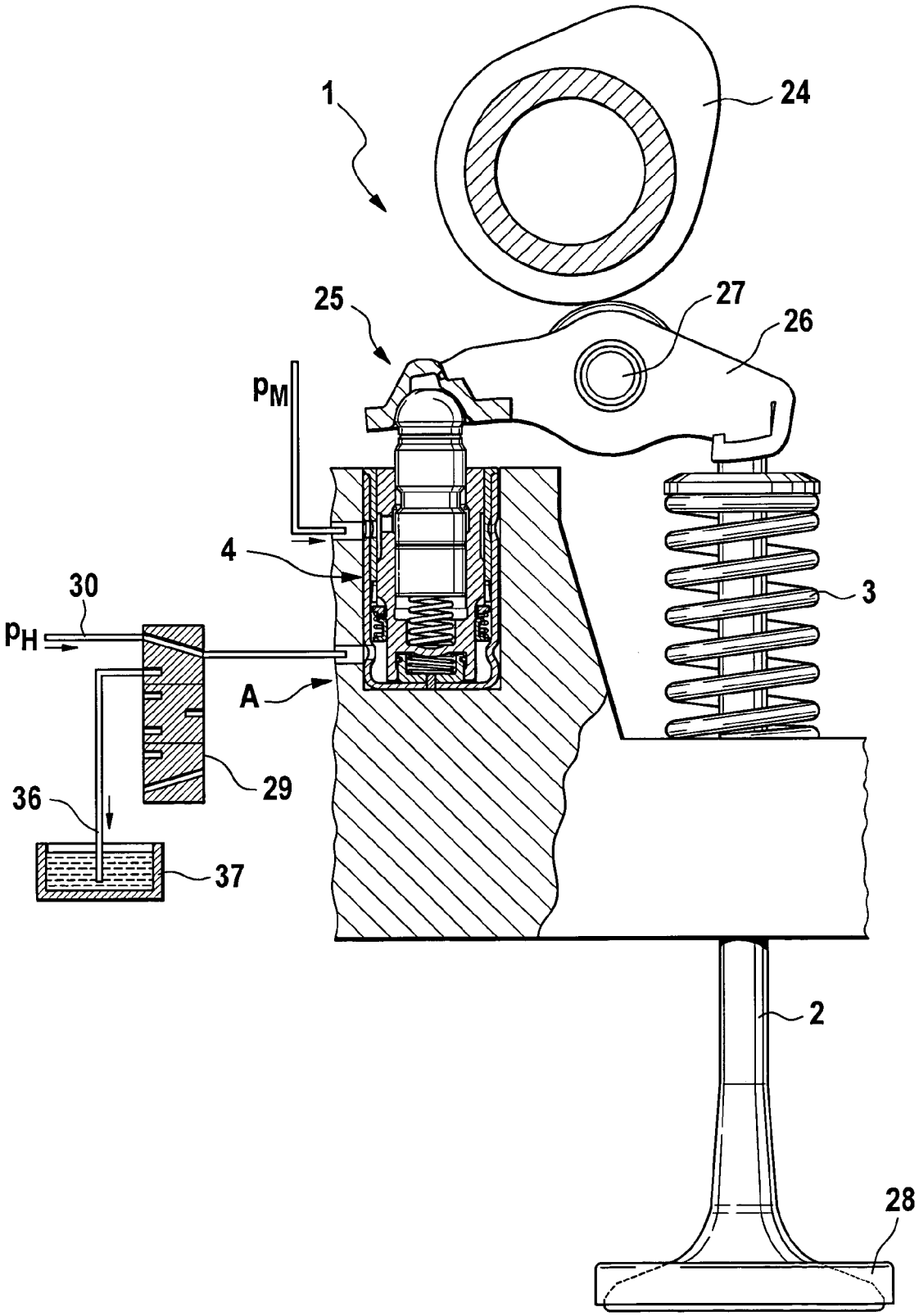
FIG. 1 a finger lever drive shown partially in cross section, with the force application device, finger lever, camshaft, and valve.
Figure 2:
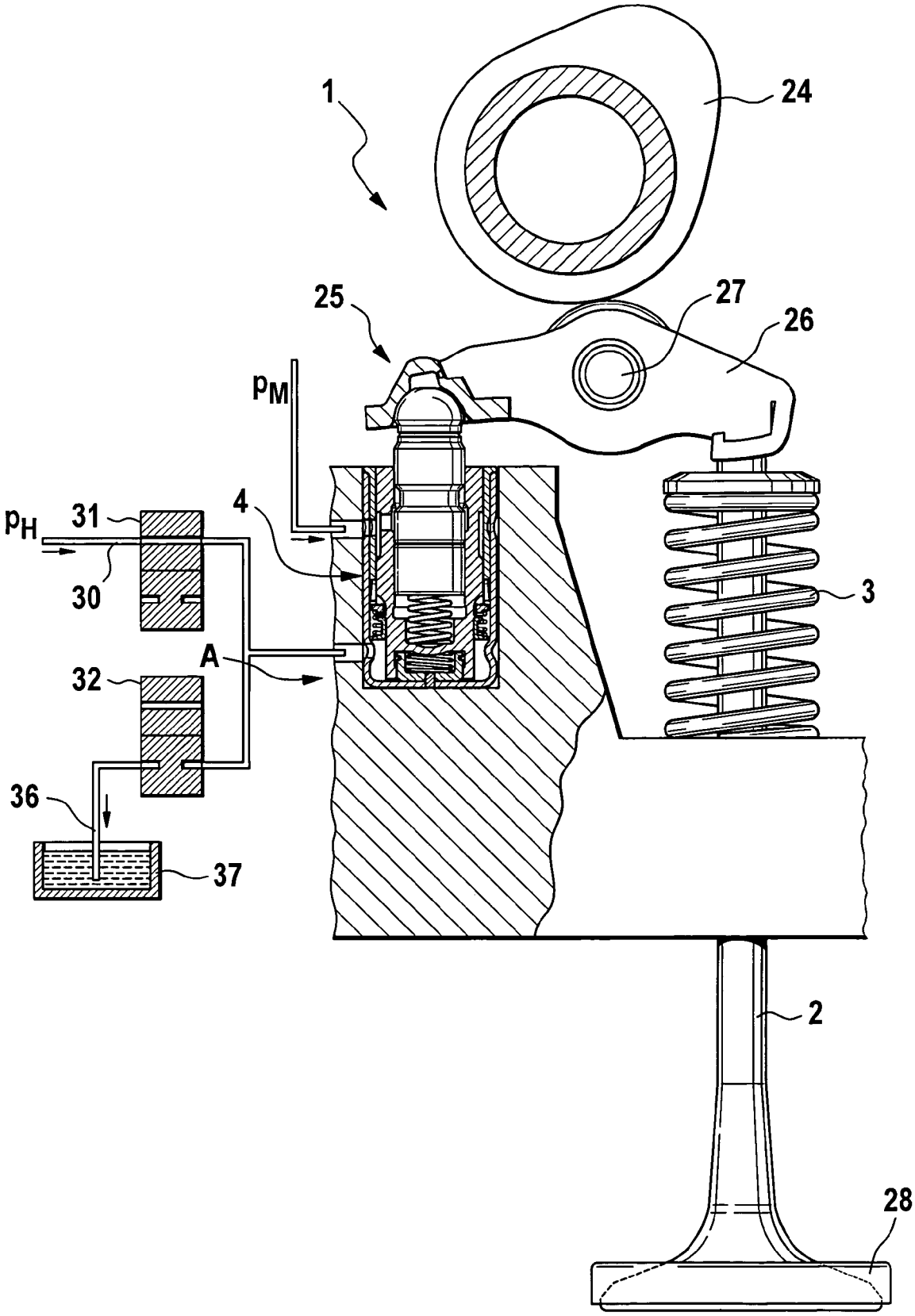
FIG. 2 the same illustration as in FIG. 1 with an alternative hydraulic controlling of the force application device.

In FIGS. 1 and 2, the basic configuration of the valve drive and its hydraulic control is shown for a finger lever drive. The illustrated embodiment provides a finger lever drive for a finger lever 26, which is supported so that it can pivot in the cylinder head of an internal combustion engine. On one side, the finger lever 26 presses on a valve 2, which has a valve seat 28 for sealing. The valve 2 is connected to a valve spring 3, which biases the valve 2 in the closing direction. A cam 24 of a camshaft operates the finger lever 26, i.e., the cam 24 applies pressure to a contact point 27 of the finger lever 26, such that the valve 2 is moved.

In order to achieve a targeted movement of the valve in addition to the movement of the valve 2 dependent on the cam shape, a force application device 4 is provided on the other side of the finger lever 26, namely at the site of the finger lever support part 25. This is charged with oil at the motor oil pressure $p_M$ (shown schematically by the arrow) and charged with hydraulic fluid (oil) under high pressure $p_H$.

For this purpose, in FIG. 1 a 3/3 port directional control valve 29 is provided. The valve 29 controls the input of hydraulic fluid under high pressure $p_H$ via an oil pressure line 30 into the force application device 4. Alternatively, in FIG. 2 it can be seen that the force application device 4 can be pressurized by two 2/2 port directional control valves 31 and 32.

The configuration of the force application device 4 is sketched for three different embodiments in FIGS. 3 and 4 or 5 or 6.

Figure 3:
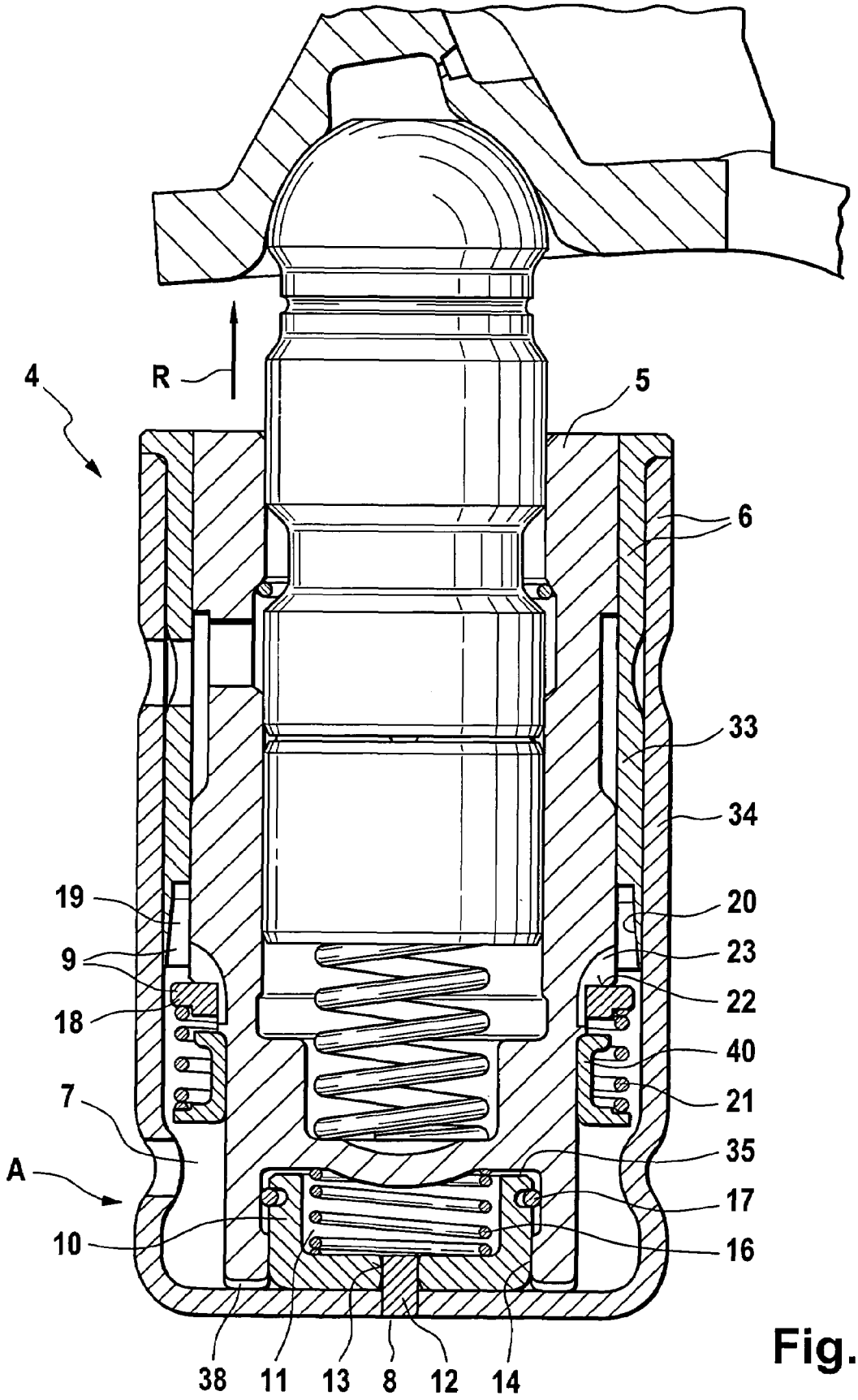
FIG. 3 an enlarged illustration of the force application device, shown in cross section.
Figure 4:
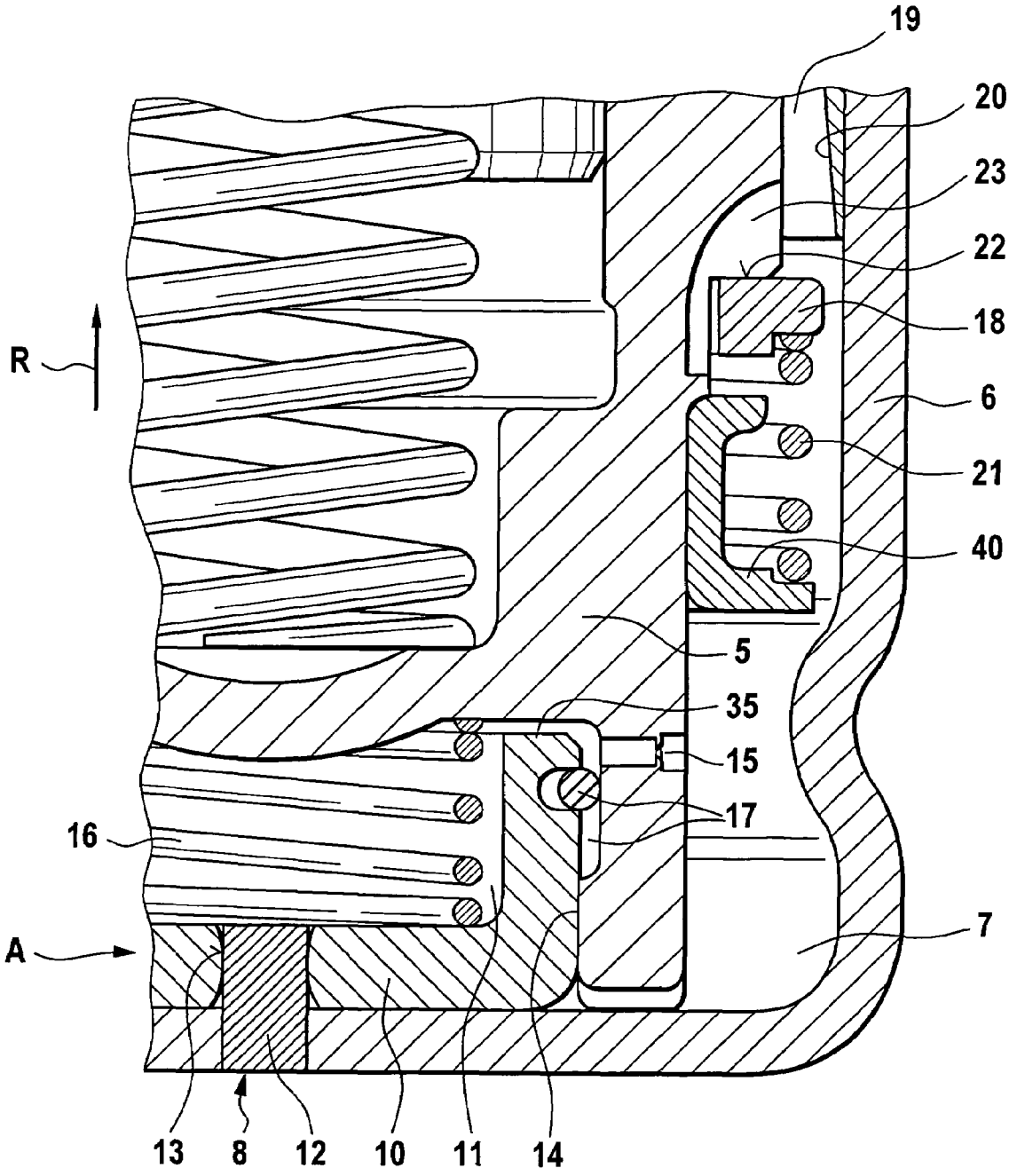
FIG. 4 a further enlarged view of the bottom right area of the force application device according to FIG. 3.

The force application device 4 has a cylinder 6, which, in the embodiment according to FIGS. 3 and 4, has a guide sleeve 33, which is connected with a positive fit and pressure-tight to an outer housing 34; the guide sleeve 33 has a one-sided collar, which acts as an axial stop for joining the parts 33 and 34.

In the cylinder 6, there is a piston 5 which can be moved relative to the cylinder 6 in the displacement direction R when the pressurization is performed with high pressure oil (see FIGS. 1 and 2). Here, the high pressure oil is introduced into the pressure chamber 7 formed between the piston 5 and cylinder 6.

Here, the piston 5 can assume two end positions A and B in the cylinder 6. The first, bottom end position is designated with A and sketched in FIGS. 1, 2, 3, 4, and 5. The second, top end position B is shown in FIG. 6.

In order to achieve end position damping or braking both in the bottom and also in the top end position A, B, the force application device 4 has a system 8 for braking the movement of the piston 5 in the bottom end position A and a system 9 for braking the movement of the piston 5 in the top end position B.

The braking system 8 is formed from a cup-shaped braking piston 10, which is arranged concentrically in a cylindrical recess 14 in the piston 5, which is movable in the displacement direction R relative to the piston 5. An oil chamber 11, which is sealed from the pressure chamber 7, is formed between the braking piston 10 and the piston 5. The fit between the cylindrical recess 14 and the braking piston 10 is selected accordingly. The displacement movement of the braking piston 10 relative to the piston 5 is limited by limiting means 17 (spring ring and groove). A spring element 16 in the shape of a helical spring applies a force on the braking piston 10, so that this is pressed away from the piston 5, wherein this movement is limited by the limiting means 17.

In the braking piston 10, there is a fluid opening 13, which can be opened or closed by closing element 12 in the form of a pin as a function of the relative position of the braking piston 10 to the cylinder 6, concentric to the longitudinal axis of the force application device 4. Here, the pin 12 is anchored rigidly in the cylinder 6. Optionally the pin 12 can be completely eliminated or formed as a cone or sphere through suitable shaping of the contact surface between the braking piston 10 and the cylinder 6.

As can be seen further in FIG. 4, an aperture 15 is provided between the oil chamber 11 and the pressure chamber 7, which enables hydraulic fluid to flow from the oil chamber 11 into the pressure chamber 7.

If hydraulic fluid is input via the oil pressure line 30 (see FIGS. 1 and 2) into the pressure chamber 7, the piston 5 moves in the displacement direction R upwards out of the bottom end position A. Here, a negative pressure is produced in the oil chamber 11, because the braking piston 10 is pulled away from the stationary pin 12. In order to prevent cavitation due to large negative pressures, an annular gap is provided between the top edge 35 of the braking piston 10 and the piston 5, whose volume corresponds at least to the volume of the pin 12 pulled from the fluid opening 13. Therefore, a relative movement between the piston 5 and braking piston 10 is possible.

As soon as the pin 12 is pulled completely from the fluid opening 13 of the braking piston 10, the oil chamber 11 can be expanded by the spring element 16, in that now oil is fed through the now open fluid opening 13. This expansion is limited by the limiting means 17.

Through the displacement of the piston 5 directed upwards in the displacement direction R, the valve 2, independent of the influence of the cam 24, is opened. To close the valve 2, the return path 36 is opened by the directional control valve 29 (see FIG. 1) or 32 (see FIG. 2), so that the hydraulic fluid can flow back into a storage tank 37. Here, the piston 5 moves downwards due to the force acting on the finger lever 26 and stored in the valve spring 3.

In the course of the downwards movement, the pin 12 is inserted into the fluid opening 13 in the floor of the braking piston 10, whereby the fluid opening is closed. Starting at the time of receiving the contact of the braking piston 10 with the cylinder 6, the braking piston 10 moves relative to the piston 5, whereby oil is forced from the oil chamber 11 and fed via the aperture 15 (see FIG. 4) to the pressure chamber 7. The pressure build-up in the oil chamber 11 brakes the valve 2 and damps the sliding in the valve seat 28.

Thus, the pin 12 replaces an expensive and space-intensive non-return valve of a conventional type, e.g., a spring-loaded ball non-return valve.

In the piston 5, there is an oil passage 38 in order to equalize pressure differences between the volume spaces bordering each other.

With the described solution, there is the possibility of setting a defined valve seat speed in the bottom end position A or a desired damping or braking of the movement of the valve 2 when this position is reached.

Figure 5:
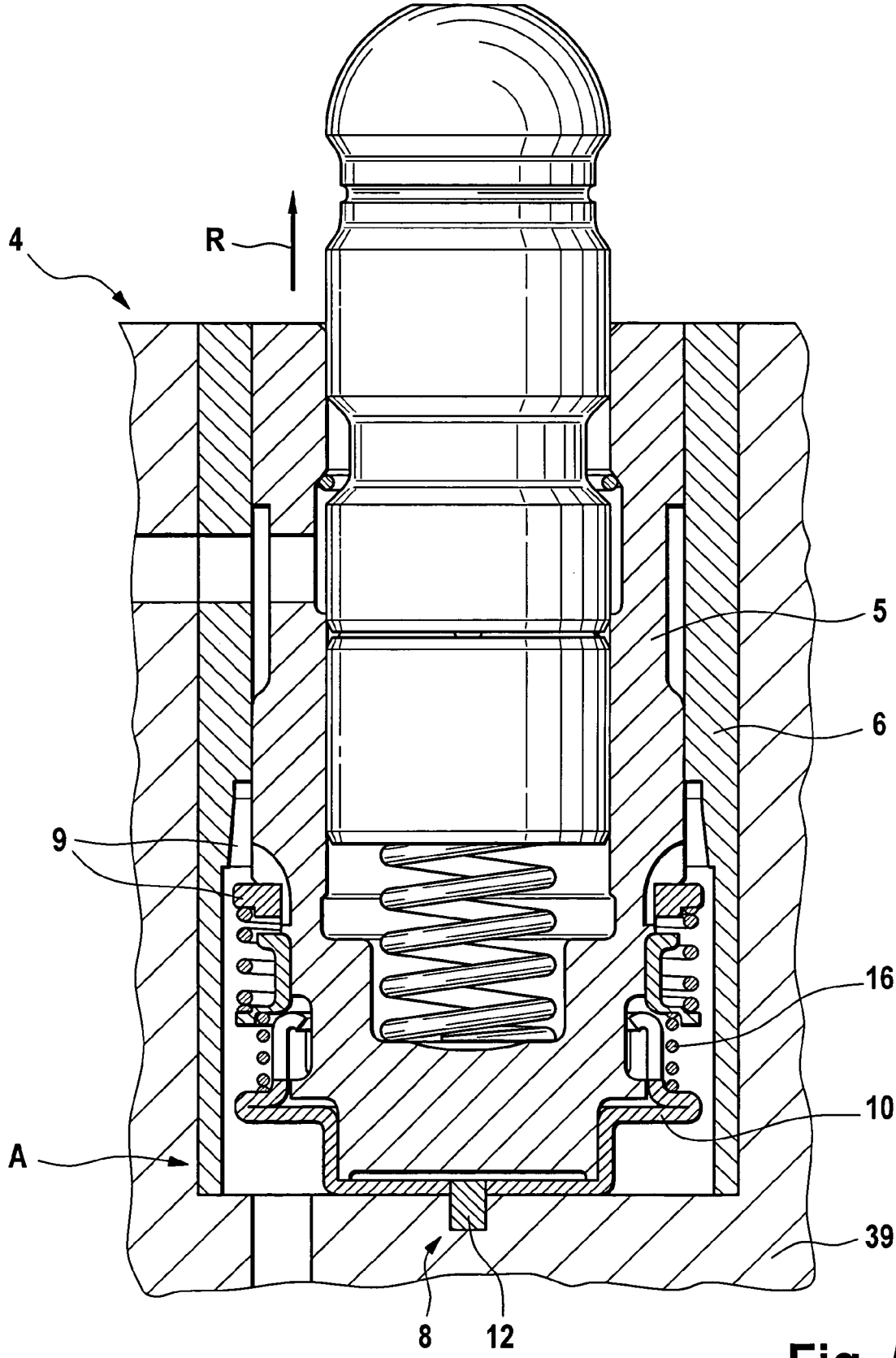
FIG. 5 an alternative configuration of the force application device in the illustration according to FIG. 3 shown in cross section.
Figure 6:
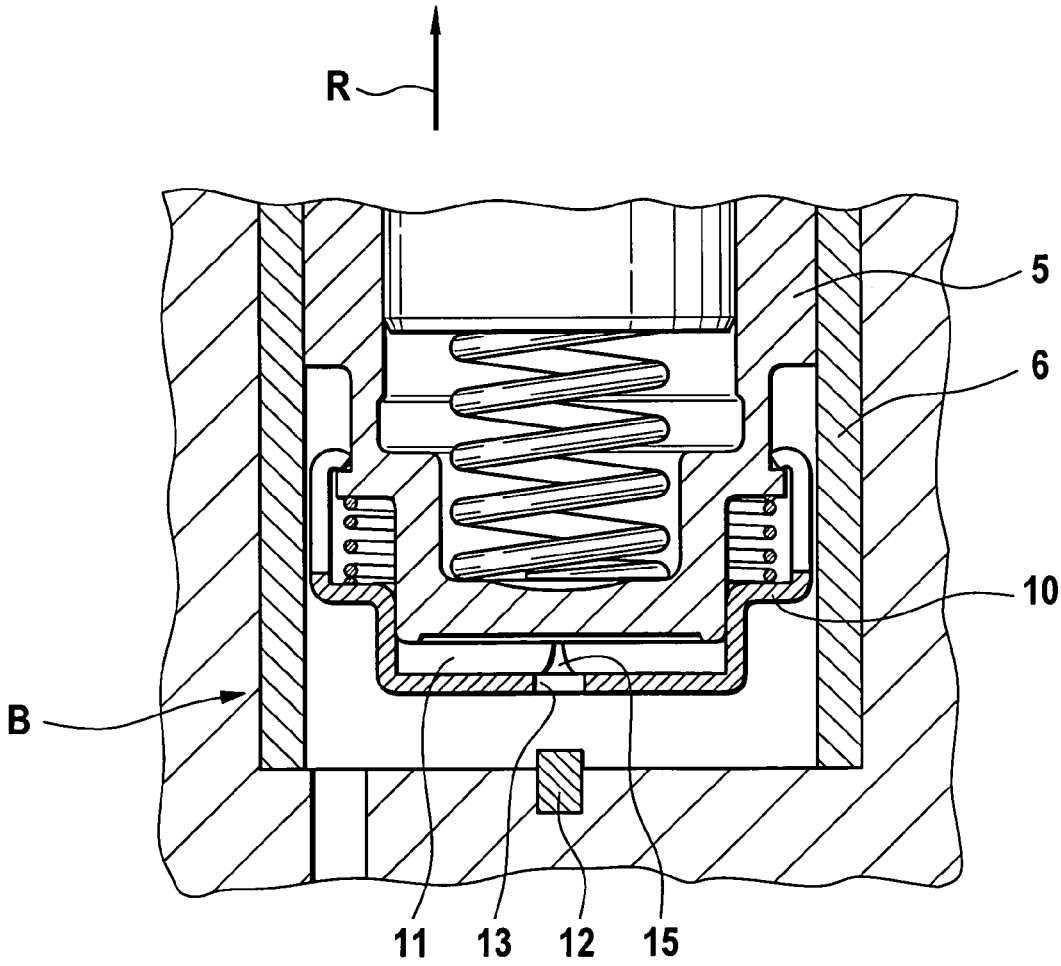
FIG. 6 another alternative configuration of the force application device, shown in cross section, wherein only its bottom half is shown.

Alternative configurations of the invention are shown in FIGS. 5 and 6. For the embodiment according to FIG. 5, the braking piston 10 surrounds the piston 5 from the outside. Here, the pin 12 is arranged in the cylinder head 39. Therefore, it is possible to embody the guide sleeve 33 (see FIG. 3) and the outer housing 34 as a one-piece component 6 (see FIG. 5), whereby the manufacturing costs can be reduced.

The aperture 15 (see FIG. 4) has linear damping characteristics due to the fixed aperture cross section. It offers the advantage of damping essentially decoupled from the oil viscosity. If the damping or braking effect is to be freely shaped as a function of the displacement path, an aperture 15, as shown in FIG. 6, can be used, which has a varying throttling cross section over the displacement path.

For the pressurization of the pressure chamber 7, if the piston 5 moves upwards and approaches its top end position B, a top end position damping of the piston 5 is performed by the means 9 shown in FIGS. 3, 4, and 5. Thus, damping or braking of the opening movement of the piston 5 is performed when the maximum valve lifting is reached.

The damping or braking is performed as soon as a damping plate 18 arranged concentrically around the piston 5 enters a cylindrical and/or conical damping chamber 19 due to the upwards movement of the piston 5. Here, the damping chamber 19 has a side wall 20, which has the shown shape.

The damping plate 18 is pressed against an axial stop 22 on the piston 5 by a spring element 21. The spring element 21 is supported against a counter support 40 with a U-shaped cross section.

As mentioned, the damping or braking of the movement of the piston 5 begins as soon as the damping plate 18 enters the damping chamber 19 due to the upwards movement of the piston 5. As soon as the flow resistance rising due to the narrowing throttle gap exceeds the spring force of the spring element 21, the damping plate 18 is pressed away from the axial stop 22 and against the counter support 40. The flat surfaces of the two components 18 and 40 seal the damping chamber 19, in that an overflow channel 23 that is opened when the damping plate 18 contacts the piston 5 is closed. Due to the volume flow reduced by the throttle gap, the lifting of the piston 5 is damped.

Instead of a narrowing throttle gap, a damping device with aperture characteristics can also be provided.

After reaching the top end position B and opening the return path 36 (see FIGS. 1 and 2) due to corresponding switching of the valves 29, 31, 32, the piston 5 is moved downwards by the valve spring 3 acting via the finger lever 26.

In order to achieve acceleration that is as quick as possible and that is free from losses in flow from the top end position B, the spring element 21 moves the damping plate 18 in the course of the upwards movement against the axial stop 22. In this way, the overflow channel 23 is opened again, so that the hydraulic fluid can flow unhindered into the damping chamber 19.

The top end position damping simultaneously takes over the function of a mechanical maximum stroke limiter. Therefore, flow losses are prevented, like those that occur in conventional system with stroke limiting by hydraulic shut-off.

Overall, end-position damping that can be realized easily on both ends of the movement of the piston 5 of the force application device 4 is realized.

In the exemplary embodiment, the use of the force application device 4 was explained for a finger lever drive through hydraulic displacement of the finger lever support. It is also possible to use of the inventive concept in a tappet drive or in the support for a rocker arm.

List of reference symbols

| | |
|---|---|
| 1 | Valve drive |
| 2 | Valve |
| 3 | Valve spring |
| 4 | Force application device |
| 5 | Piston |
| 6 | Cylinder |
| 7 | Pressure chamber |
| 8 | System for braking the movement of the piston |
| 9 | System for braking the movement of the piston |
| 10 | Braking piston |
| 11 | Oil chamber |
| 12 | Closing means |

-continued

| List of reference symbols | |
|---|---|
| 13 | Fluid opening |
| 14 | Cylindrical recess |
| 15 | Aperture |
| 16 | Spring element |
| 17 | Limiting means |
| 18 | Damping plate |
| 19 | Damping chamber |
| 20 | Side wall of the damping chamber |
| 21 | Spring element |
| 22 | Axial stop |
| 23 | Overflow channel |
| 24 | Cam |
| 25 | Finger lever support part |
| 26 | Finger lever |
| 27 | Active position |
| 28 | Valve seat |
| 29 | 3/3 port directional control valve |
| 30 | Oil pressure line |
| 31 | 2/2 port directional control valve |
| 32 | 2/2 port directional control valve |
| 33 | Guide sleeve |
| 34 | Outer housing |
| 35 | Edge |
| 36 | Return path |
| 37 | Storage tank |
| 38 | Oil passage |
| 39 | Cylinder head |
| 40 | Counter bearing |
| R | Displacement direction |
| A | First (bottom) end position |
| B | Second (top) end position |
| $p_M$ | Motor oil pressure |
| $p_H$ | High pressure |

The invention claimed is:

1. Valve drive for a cam-operated valve of an internal combustion engine, in which the valve is loaded by a closing force against an opening direction of the valve by a valve spring, the valve drive comprising a hydraulic force application device, with which a force can be applied directly or indirectly against a direction of the closing force onto the valve, the force application device including a piston moveable in a displacement direction (R) relative to a cylinder of the force application device through introduction of hydraulic fluid into a pressure chamber formed between the piston and the cylinder, wherein the piston can be moved relative to the cylinder from a first end position (A) into a second end position (B), a braking or damping system to brake movement of the piston relative to the cylinder from when a predetermined relative position is reached between the piston and the cylinder until one of the end positions is reached, the braking or damping system is formed by a braking piston, which is supported so that it can move relative to the piston in the displacement direction and can be moved relative to the cylinder in the displacement direction, wherein an oil chamber is formed between the piston and braking piston, which is sealed from the pressure chamber formed between the piston and cylinder, and a closing element, which open a fluid opening after a predetermined displacement of the braking piston relative to the cylinder is exceeded and close the fluid opening again after falling below the predetermined displacement, whereby a fluid connection can be created or blocked between the pressure chamber formed between the piston and the cylinder and the oil chamber.

2. Valve drive according to claim 1, wherein the braking piston is supported in a cylindrical recess in the piston.

3. Valve drive according to claim 1, wherein there is an aperture, which allows an overflow of hydraulic fluid from the oil chamber into the pressure chamber between the pressure chamber formed between the piston and cylinder and the oil chamber formed between the piston and braking piston.

4. Valve drive according to claim 3, wherein the aperture has a constant aperture cross section over a displacement path between the piston and the braking piston.

5. Valve drive according to claim 3, wherein the aperture has a varying aperture cross section over a displacement path between the piston and braking piston.

6. Valve drive according to claim 1, wherein the closing means are formed by a pin, which is connected rigidly to the cylinder and which interacts with the fluid opening in the braking piston.

7. Valve drive according to claim 6, wherein the piston, braking piston, and pin are arranged concentric to a longitudinal axis of the force application device.

8. Valve drive according to claim 1, wherein a spring element, which presses the braking piston away from the piston, is provided between the piston and braking piston.

9. Valve drive according to claim 1, further comprising limiting means, which limit a displacement path of the braking piston relative to the piston.

10. Valve drive for a cam-operated valve of an internal combustion engine, in which the valve is loaded by a closing force against an opening direction of the valve by a valve spring, the valve drive comprising a hydraulic force application device, with which a force can be applied directly or indirectly against a direction of the closing force onto the valve, the force application device including a piston moveable in a displacement direction relative to a cylinder of the force application device through introduction of hydraulic fluid into a pressure chamber formed between the piston and the cylinder, wherein the piston can be moved relative to the cylinder from a first end position into a second end position, a braking or damping system to brake movement of the piston relative to the cylinder from when a predetermined relative position is reached between the piston and the cylinder until one of the end positions is reached, and the braking or damping system comprises a damping plate, which is arranged concentrically around and is movable relative to the piston and which can enter a damping chamber formed in the cylinder for the movement of the piston relative to the cylinder into one of the end positions.

11. Valve drive according to claim 10, wherein the damping chamber is in fluid connection with the pressure chamber formed between the piston and cylinder or is a component of the pressure chamber.

12. Valve drive according to claim 10, wherein the damping chamber has a radially outer, conical side wall.

13. Valve drive according to claim 10, wherein the damping plate is pressed against an axial stop on the piston by a spring element.

14. Valve drive according to claim 13, wherein in a position contacting the axial stop, the damping plate opens an overflow channel between the pressure chamber formed between the piston and cylinder and the damping chamber and, in a state pressed away from the axial stop, the damping plate closes the overflow channel.

15. Valve drive for a cam-operated valve of an internal combustion engine, in which the valve is loaded by a closing force against an opening direction of the valve by a valve spring, the valve drive comprising a hydraulic force application device, with which a force can be applied directly or indirectly against a direction of the closing force onto the valve, the force application device including a piston moveable in a displacement direction relative to a cylinder of the force application device through introduction of hydraulic fluid into a pressure chamber formed between the piston and the cylinder, wherein the piston can be moved relative to the cylinder from a first end position into a second end position, a braking or damping system to brake movement of the piston relative to the cylinder from when a predetermined relative position is reached between the piston and the cylinder until one of the end positions is reached, and wherein the force application device is part of a finger lever support part for supporting a finger lever operating the valve.

* * * * *